United States Patent [19]

Crook et al.

[11] Patent Number: 4,771,263

[45] Date of Patent: Sep. 13, 1988

[54] VARIABLE RESISTANCE SWITCH

[75] Inventors: Frederick L. Crook, Waukesha, Wis.; Gino P. Domenella, Mt. Prospect, Ill.

[73] Assignee: Milwaukee Electric Tool Corporation, Brookfield, Wis.

[21] Appl. No.: 82,522

[22] Filed: Aug. 6, 1987

Related U.S. Application Data

[63] Continuation-in-part of Ser. No. 912,391, Sep. 26, 1986, abandoned.

[51] Int. Cl.[4] ..... H01C 10/38

[52] U.S. Cl. ..... 338/176; 338/306; 338/314

[58] Field of Search ..... 338/176, 165, 160, 304–314

[56] References Cited

U.S. PATENT DOCUMENTS 4,495,524 1/1985 Kakuhashi et al. ..... 338/314

4,680,570 7/1987 Hehl ..... 338/176

*Primary Examiner*—E. A. Goldberg

*Assistant Examiner*—Marvin M. Lateef

*Attorney, Agent, or Firm*—Bayard H. Michael

[57] ABSTRACT

The variable resistance speed control switch for a power tool has a wiper which slides over a resistor which has a non-linear resistance curve matched to the motor. The resistor is made by thick film technology and has a ceramic substrate covered by 950° C. glass and fired to give the substate a glass smooth surface. Then a 100K ohm ink is applied in a pattern designed to give a non-linear resistance curve tailored to the performance of the motor. A resistive termination is provided to diffuse the power concentation under the stationary contact. A 1 meg ohm ink covers the 100K layer and part of the terminaton. The 1 meg ink contains a lot a glass which fuses and flows out when fired. The 1 meg ink will flow out to the same glass smooth condition as the glass bottom layer. The wipers are not subject to much abrasion or wear.

5 Claims, 1 Drawing Sheet

VARIABLE RESISTANCE SWITCH

This application is a continuation-in-part of our application Ser. No. 912,391 filed Sept. 26, 1986, now abandoned.

FIELD OF THE INVENTION

This invention relates to variable resistance speed control switches of the type having contact wipers movable over a resistance strip. More particularly, this invention relates to improvements in the resistance strip increasing the life of the switch.

BACKGROUND OF THE INVENTION

Since trigger operated variable resistance speed control switches used on hand power tools operate under severe viabratory and power conditions, the switches tend to have a shorter life than desired. They are subject to burn-out at the juncture of a fixed contact with the resistance strip termination (terminal). The switch contact wipers tend to wear out due to the abrasive nature of the resistance surface engaged by the wipers. The resistance switch wiper has linear travel but the resistance change should be non-linear and matched to the operating characteristics of the motor. The prior art solution has been costly. Switches of this type customarily have a finger-type contact engaging the contact end of the resistance strip. The contact end has customarily been a conductor and this results in a high power density which can lead to pitting and failure.

SUMMARY OF THE INVENTION

An object of this invention is to provide for switches of the type described a resistance strip which, by reason of its construction, greatly improves the performance and reliability of the switch.

Another object of this invention is to provide a resistance strip having a very smooth, glass-like, nonabrasive surface.

The typical substrate used in thick film technology is a ceramic which feels quite smooth to the touch, but which is relatively rough, as may be appreciated when viewing the surface under magnification. We find that coating the substrate with 950° C. glass (glass which melts at 950° C.) provides a very smooth surface on the substrate. When resistor ink is applied over such a glassy surface and is subsequently fired, the resistor surface tends to take the smooth nature of the glass substrate. Therefore, the surface of the resistor is glass-like and causes only slight wear of the wiper contacts moving across the surface, thus greatly extending the life of the contacts. While the prior art has applied glass over a ceramic base, it was done in conjunction with thin film technology and not used under a switch wiper.

Another object is to provide special resistance values at low cost. Special resistance values have been provided by utilizing special mixes of resistance materials. This approach entails extra expense and sacrifices design flexibility. We find that multi-layer applications of different resistor materials can achieve the desired end with no cost penalty (except for the extra layer) and without sacrifice of design flexibility. The initial resistor material is applied to the substrate in a pattern of uniform thickness. This gives non-linear resistance characteristics when wiped by a wiper having linear travel. The non-linear characteristic can be matched to the motor with which the switch is to be used. The application of a second layer covering the first does not destroy the non-linear characteristics of the built-up resistance strip.

Still another object is to provide an improved contact termination. Resistor strips have been terminated by application of a conductor to the end of the resistance strip. Electric power is transferred to the strip through a contact finger resting on the terminal. The contact has substantially point contact and this results in a large amount of power being transferred in a very small area and results in creating voids in the conductor material during full power operation. Our improved termination uses a resistive termination instead of a conductor. This diffuses the power transfer area and avoids failure or pitting under the contact finger. Another advantage is that the serial resistance added into the circuit through use of the resistive termination reduces the amount of power required for the shaped resistor strip and this enhances the life of the strip.

DETAILED DESCRIPTION OF THE DRAWINGS

Figure 1:
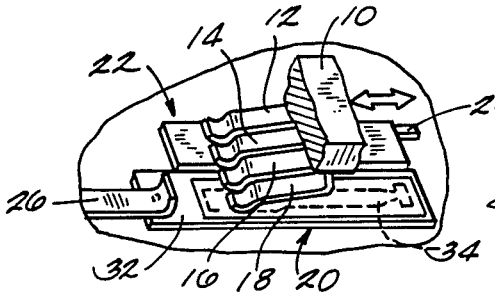
FIG. 1 is a fragmentary view of a slider/wiper and the resistor and conductor over which the wiper moves to vary resistance in a speed control switch.

A speed control switch has a trigger which is actuated to move the wiper carrier 10 to slide the wipers 12, 14, 16, 18 along the resistance strip 20 and the conductor strip 22. All of the wipers are connected together. Wipers 12 and 14 wipe the resistor strip 20 and contact wipers 16 and 18 wipe the conductor strip 22. A lead 24 from the conductor strip 22 can be connected into a circuit while power can be applied to the resistance strip 20 through a fixed contactor 26 which, as can be seen, engages the end of the termination 32. Thus, power can be applied through terminal 26 to terminal 32 and the variable resistance (to be described) to the wipers 12 and 14 and then through wipers 16 and 18 to the contact strip 22. Power can then be taken off at terminal 24. This is a very simplified description, but it will be appreciated that as the carrier moves to the right in FIG. 2, wipers will start at the left end of the resistance strip 20 and move towards the right. This will change the amount of resistance in circuit between terminal 26 and terminal 24 and this, in turn, will determine the speed of the motor in conjunction with other components of the circuit not relevant here.

The resistance strip 20 has a ceramic substrate 28 which is customary in thick film technology while the ceramic feels smooth it is actually rough and abrasive enough to wear down the wipers. To get a smooth base for the subsequent thick film resistance layers a layer of 950° C. glass 30 is applied to the substrate and fired. This results in a glass smooth surface over the substrate.

Figure 2:
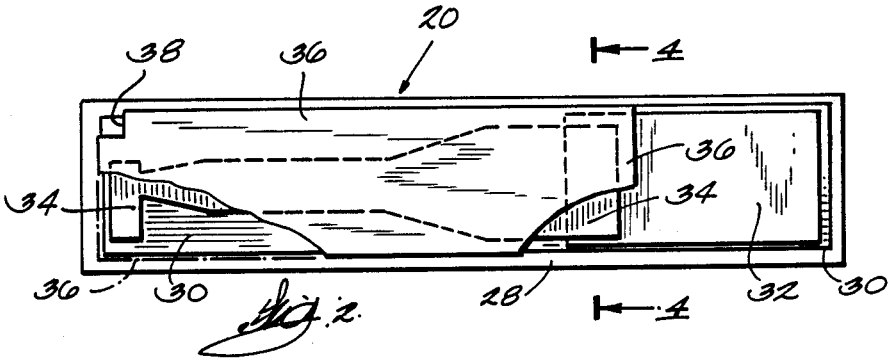
FIG. 2 is a plan view, with parts broken away, showing the various thick film layers in the production of the non-linear resistance.

The next step is to apply a 10K. ohm paste to the right end of the glass covered substrate over the area 32 indicated in FIG. 2. This functions as a resistance termination 32 (rather than the customary noble metal terminal) to the resistance strip.

Figure 3:
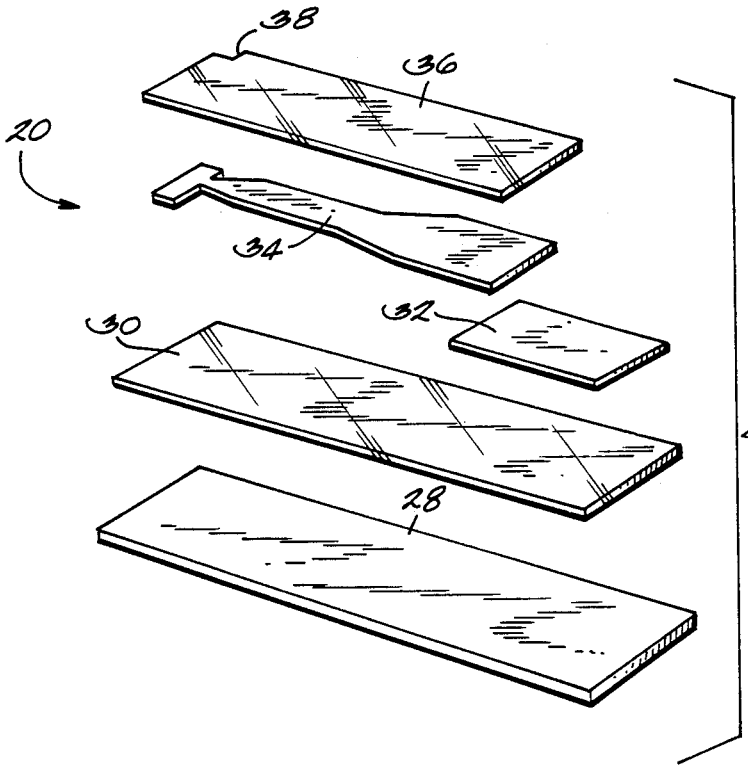
FIG. 3 is an exploded perspective view of the non-linear resistance (it should be understood the layers 30, 32, 34, 36 are extremely thin relative to the substrate 28).

The principal resistance strip, and the one which gives the control its non-linear resistance characteristic, is the 100K. ohm pattern 34 which has the configuration shown in greatest detail in FIG. 2. This layer has uniform thickness and requires no special cuts in the glass covered substrate. After this ink has dried, 1 meg ohm ink is applied over the area indicated by pattern 36. This pattern 36 has a notch or cut-out 38 at the upper left in FIGS. 2 & 3. This leaves the color of the glass layer exposed to help the workers in orienting the resistance strip in the switch during assembly. The right end (FIG. 2) of layer 36 only partly covers the terminal 32, thus leaving the right portion of the terminal exposed for engagement by contact 26.

After firing the inks appear black; the termination 32 will appear as a flat black, while the remainder appears as a glossy black. This is due to the fact there is more glass content in the 1 meg ink and it takes on a glass-like sheen after firing. The 10K. paste making terminal 32 has relatively low glass content and does not develop a gloss. The 100K. and 1 meg inks are applied to the 950° C. glass previously applied to the substrate and fired. Thus, since the ink layers are applied to glass, they tend to take on the characteristics of the glass substrate. Therefore, the surface of 36 is glass smooth and not abrasive to the wipers 12, 14, 16, 18. If layers 34, 36 were applied to the ceramic base instead of the glass covered base, they would not have the glass-smooth surface.

The non-linear resistance characteristics obtained by the 100K. resistance pattern reflect in the finished product and obtain a tailored characteristic for the motor with which the switch will be used. Different motors may have different requirements and the pattern can be modified accordingly. Layers 34 and 36 are easily applied by thick film technology.

The requirements of a switch of this type for the total resistance of the finished stip have a rather broad range. A typical switch for which this switch was developed will end up with a resistance value between 610K. and 960K. Any value in that range will be satisfactory in the use. 0f course, as the wipers move to the right (FIG. 2), the actual resistance in the circuit keeps dropping until it reaches a low value at full speed. The resistance varies with variation in point of contact of the wipers transverse the strip as well as along the strip. But the basic character of the resistance variation is determined by the shape of the 100K. pattern. The use in controlling motor speed can tolerate considerable variation of value at a given wiper position but the character of the variation should fit the motor.

We claim:

1. A switch comprising, a housing, a carrier slideably mounted in said housing, a resistance strip mounted in said housing, a wiper mounted on said carrier to wipe across said strip from one end to the other of said strip, said strip having a ceramic substrate with a thick film of high temperature glass fired thereon and including upper and lower layers of dissimilar resistor material applied on said glass over the same general area, the lower layer having a non-uniform pattern so the resistance between a point along the layer and one end of the lower layer changes in a non-uniform manner, the upper layer having a pattern which completely covers the lower layer and having a higher resistance value than said lower layer, both of said upper and lower layers being fired at a temperature below the firing temperature of said glass and having a glassy smooth surface.

2. A switch according to claim 1 including a resistive termination applied to said glass, and in which said multiple layers partially overlap said termination.

3. A resistor comprising, a ceramic substrate, a thick film glass layer fired on said substrate to obtain a glassy smooth surface, multiple layers of dissimilar resistive layers fired on said glass layers and having different geometric patterns, the uppermost layer covering the lower layer and having the highest resistive value, said multiple layers having a glassy smooth surface.

4. A resistor according to claim 3 in which the melting temperature of said glass layer is higher than the firing temperature of said resistive layers.

5. A resistor according to claim 4 including a resistive termination in overlapping relation with an end of said multiple layers.

* * * * *